United States Patent [19]

Hida

[11] 4,359,955

[45] Nov. 23, 1982

[54] DETACHABLE PRESSER FOOT

[75] Inventor: Kazuo Hida, Tokyo, Japan

[73] Assignee: Koshin Seimitsu Kikai Kabushiki Kaisha, Japan

[21] Appl. No.: 283,888

[22] Filed: Jul. 16, 1981

[51] Int. Cl.[3] ..... D05B 29/12

[52] U.S. Cl. ..... 112/240; 112/150

[58] Field of Search ..... 112/235, 240, 150, 236

[56] References Cited

U.S. PATENT DOCUMENTS

| | | | |
|---|---|---|---|
| 3,145,674 | 8/1964 | Kurihara | 112/240 |
| 3,973,508 | 8/1926 | Eguchi et al. | 112/240 |
| 4,178,865 | 12/1979 | Odermann et al. | 112/240 X |

*Primary Examiner*—Werner H. Schroeder

*Assistant Examiner*—Andrew M. Falik

*Attorney, Agent, or Firm*—McGlew and Tuttle

[57] ABSTRACT

A presser foot is disclosed which includes a quick connection and disconnection apparatus for connecting the presser foot shoe thereof to a connecting member which is adapted to be connected to a presser foot bar of a sewing machine utilizing the presser foot. Both the shoe and the connecting member include pairs of supports or limbs which are engaged to each other in a pivotal manner. One engagement is through a biased pin which extends through alignable holes in the supports of the shoe and connecting member to engage and permit quick disengagement of the shoe from the connecting member.

8 Claims, 8 Drawing Figures

DETACHABLE PRESSER FOOT

FIELD AND BACKGROUND OF THE INVENTION

The present invention relates in general to a sewing machine and, in particular, to a new and useful means for attaching or detaching a presser foot shoe to or from a connecting member to which a presser bar is connected.

Two types of presser feet for sewing machines are known. A presser foot of one of the two types is directly attached to a presser bar with a set screw. In this arrangement, the presser foot must be made of similar material as the bar so as to possess like strength and, moreover, accuracy is required to minimize errors in the dimensions of the foot and bar.

Presser feet of the other type are shown in FIGS. 1 and 2, for example. Both consists of a shank a and a presser foot shoe b detachably joined to each other. Shank a has a slot 1 provided at its bottom while presser foot shoe b has a pair of supports or forks 2 (only one is shown in part) provided on its upper surface at opposite sides of shoe b. A shaft 3 is received in openings of both supports 2.

In order to connect shank a to presser foot shoe b, in the case of FIG. 1, shaft 3 is inserted in slot 1 whereon slot 1 is closed with the end of a horizontal portion of an L-shaped leaf spring 4, which is tightly fitted along the bottom of shank a and up along the rear wall of shank a with the upper end of leaf spring 4 fixed to shank a. Spring 4 thus engages shaft 3 between forks 2.

Slot 1 is opened by pulling leaf spring 4 with a lever 5 as shown in a dash-dot line position in FIG. 1.

Alternatively, as shown in FIG. 2, shank a is connected to presser foot shoe b by means of a lever 6 which is pivotally connected to shank a such that a claw-like end 6*d* of lever 6 is spring-biased by a spring 6*a* so as to urge shaft 3 against slot 1.

Accurate machining is thus necessary to form a clearance c between the bottom surface of shank a and the upper surface of presser foot shoe b. These conventional presser feet, therefore, rendered manufacturing complicated and costly so that they are not generally suitable for practical use.

SUMMARY OF THE INVENTION

It is an object of the present invention to provide a presser foot which is easy to handle and which has means for attaching or detaching a presser foot shoe therewith.

Accordingly, another object of the invention is to provide a presser foot which comprises a presser foot shoe having a first and second support thereon, a connecting member adapted to be fixed to a presser foot bar having a first and second limb thereon, with the first support having a knob extending therefrom and the first limb having a groove thereon pivotally engaging the knob. The second support and the second limb have alignable holes therein with a pin extending through the holes when the shoe is connected to the connecting member. A lever with biasing spring is engaged to the pin for biasing the pin into the second limb hole with the shoe and connecting member connected and for removing the pin from the second limb hole when the presser foot shoe is to be disconnected from the connecting member.

A further object of the invention is to provide the second support of the presser foot shoe with a notched cutout spaced from the hole therein so that the pin can be moved when it bears against the notch, against the bias of the biasing spring to permit engagement of the pin in the second limb hole.

A further object of the invention is to form the connecting member of a base portion and a trunk portion, the base portion having a slide part with a step therein which slides into a cut or opening in the trunk portion, with the step fixing the relative positions of the base and trunk.

A still further object of the invention is to provide such a presser foot which includes means for making parallel stitches comprising a non-circular horizontal portion extending into a recess of the trunk with an elastic lever holding the non-circular horizontal portion against the recess.

Another object of the invention is to provide the presser foot with a transparent presser foot shoe which in addition includes a bellied lens portion in the area adjacent a needle slot of the presser foot whereby stitches passing under the bellied portion are magnified.

A further object of the invention is to provide a presser foot which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
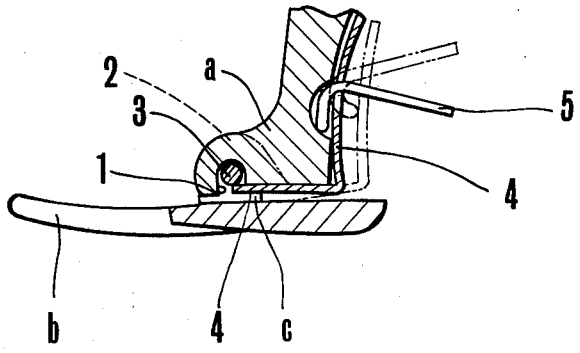
FIG. 1 PRIOR ART
FIGS. 1 and 2 are sectional views of conventional presser feet.
Figure 2:
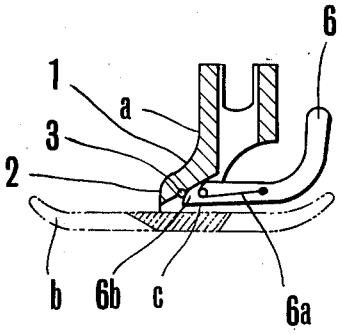
FIG. 2 PRIOR ART
Figure 3:
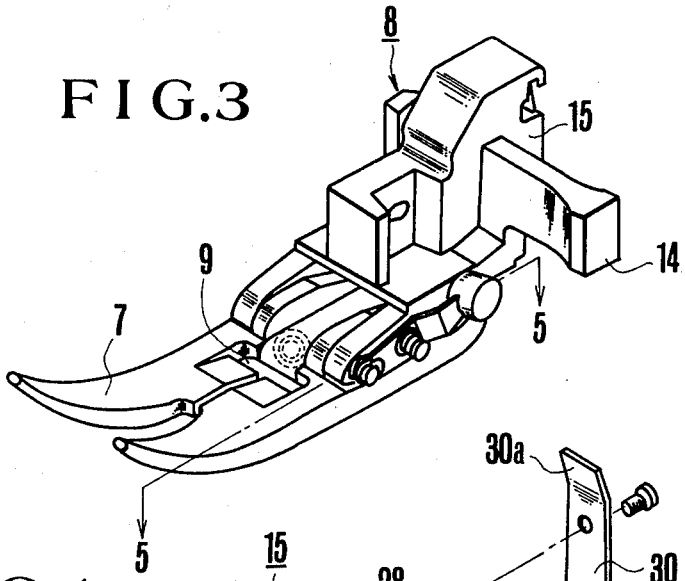
FIG. 3 is a perspective view of an embodiment of the presser foot according to the invention.
Figure 4:
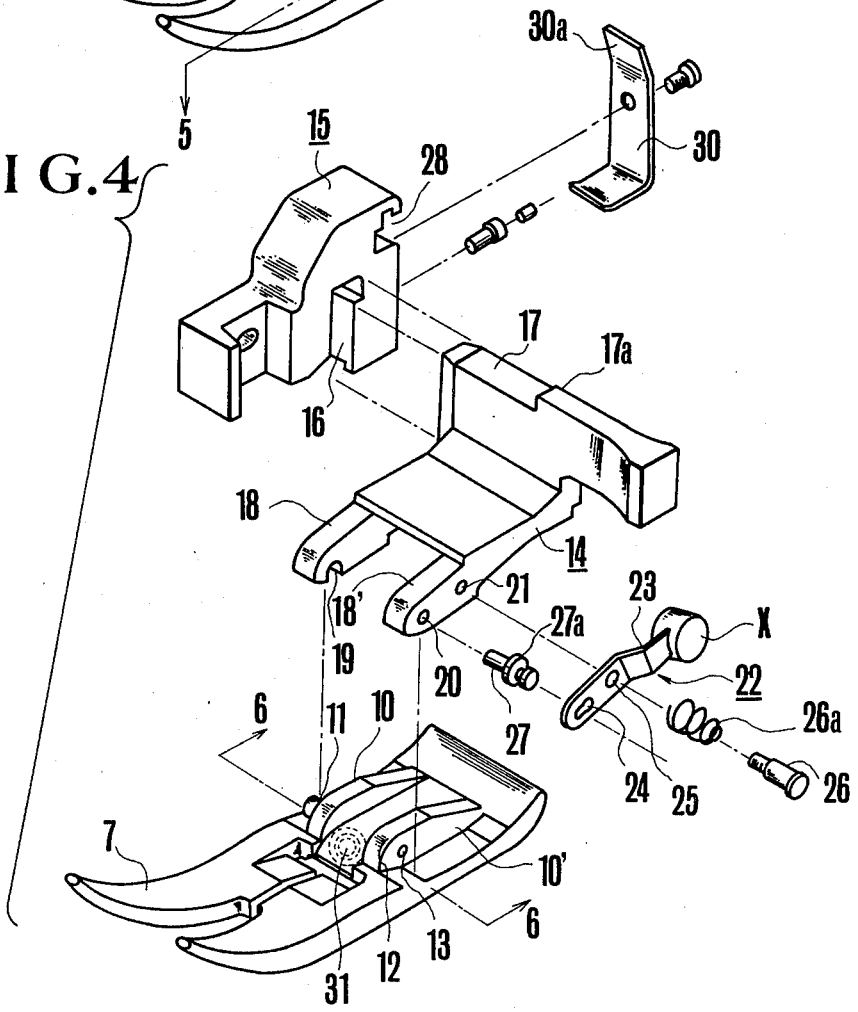
FIG. 4 is an exploded view of the embodiment shown in FIG. 3.

Referring to the drawings, and in particular to FIGS. 3 and 4, the presser foot according to the invention and embodiment therein comprises a presser foot shoe 7 and connecting member 8. Presser foot shoe 7 is formed like a sleigh-runner and is provided with a slot 9 for a needle and a pair of supports 10, 10'. Support 10 has a knob 11 adjacent its outer side and support 10' has a round notch cut 12 on the corner thereof, above a hole 13. Connecting member 8 is composed of a base 14 and a trunk 15 by which the presser foot is connected to a presser bar (not shown). Trunk 15 is provided with a cut 16. Base 14 comprises a stepped-down slide part 17 and a pair of limbs 18 and 18'. Limb 18 has a groove 19 to pivotally engage with knob 11 of presser foot shoe 7, and limb 18' is provided with holes 20 and 21. Means 22, for attaching or detaching presser foot shoe 7 to or from connecting member 8 according to the invention, consists of a lever 23 with a keyhole-like slot 24 and a hole 25. It also has a rivet 26 with a spring **26*a* and a pin 27**.

Figure 5:
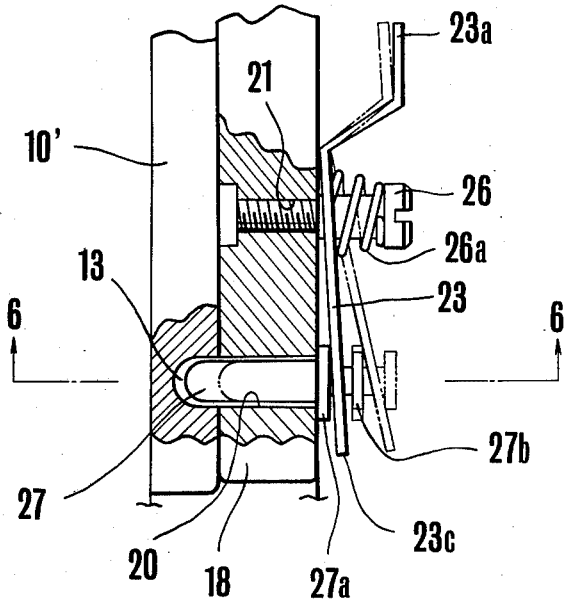
FIG. 5 is a fragmentary sectional view taken along line 5—5 in FIG. 4.

Referring to FIG. 5, lever 23 is biased toward limb 18' by the spring **26*a* of rivet 26 which is passed through hole 25 of lever 23 to be fixedly received in hole 21 of limb 18'. Pin 27 is urged by lever 23 against limb 18' with lever 23 pressing an inner rim rim 27*a* of pin 27. Pin 27 is passed through hole 20 of limb 18' for the end thereof to be received in hole 13 of support 10'**.

Figure 6:
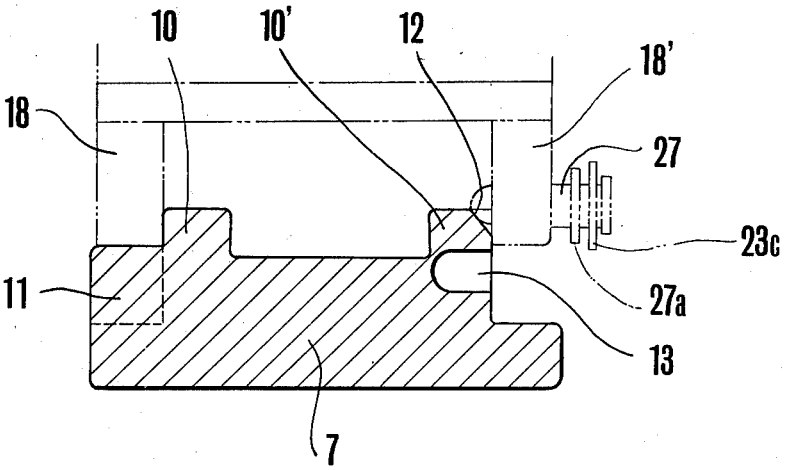
FIG. 6 is a partial cross-section view taken along line 6—6 in FIG. 5, showing a pin inserted into a hole according to the invention.

Referring to FIG. 6, presser foot shoe 7 can be attached to connecting member 8 using means 22 in the following manner: Base 14 is first joined to trunk 15 by inserting slide part 17 of base 14 into cut 16 of trunk 15 with a step **17*a* properly positioning trunk 15 with regard to base 14. Presser foot shoe 7 is then attached to connecting member 8 by means 22 with groove 19 of limb 18 engaged with knob 11 and the free end of pin 27 inserted into hole 13 of support 10'. In attaching presser foot shoe 7 to limbs 18 and 18' of base 14, round cut 12 of support 10' serves to allow the free end of pin 27 to readily slide down into hole 13 of support 10' as shown in FIG. 6**.

Presser foot 7 can be disconnected from connecting member 8 by pressing a portion **23*a* of lever 23 toward limb 18' to lift a portion 23*c* of lever 23 thereby to cause pin 27 to be pulled out of hole 13 of limb 18', thus allowing presser foot shoe 7 to be disengaged from connecting member 8. Lever end 23*c* acts on outer rim 27*b*** for this purpose.

Figure 7:
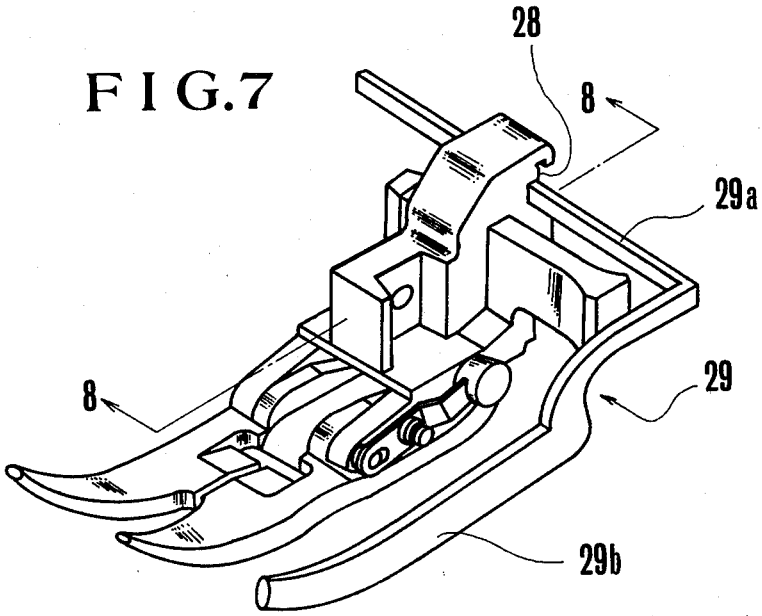
FIG. 7 is a perspective view of an embodiment of the presser foot of the invention which is provided with a bar to help make parallel stitches.
Figure 8:
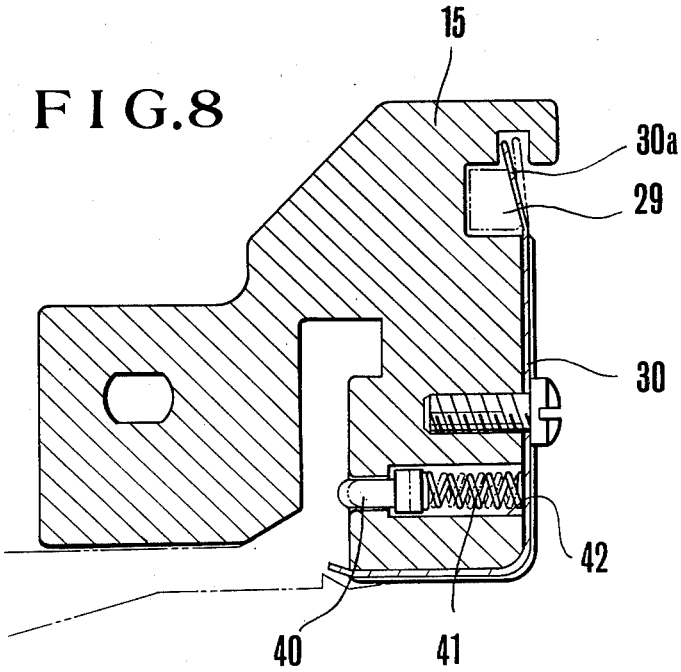
FIG. 8 is a sectional view of means for attaching or detaching the presser foot shoe to or from the presser foot according to the invention.

Referring to FIG. 7, trunk 15 has, at the upper position of its rear wall, a notch 28 for detachably receiving therein a bar 29 which aids in making parallel stitches as in quilting. Conventionally, such bars have suffered defects in that they were subject to undesirable movements due to their elasticity and/or friction which they have with the material being sewn. Because such conventional bars are circular in cross-section and fixed under pressure, the portion of the bars placed in contact with the material being sewn are liable to move up and down as the material is allowed to pass thereunder when the material is of uneven or irregular thickness as in the case, for example, of superposed materials. This finally causes the portion of the bar, initially resting on the surface of the material, to remain lifted off the material. According to the present invention, however, as shown in FIG. 8, bar 29 is quasi-rectangular or non-circular in cross-section and its horizontal portion **29*a* is supported in notch 28 of trunk 15 with the end 30*a* of an L-shaped resilient lever 30 which is fixedly secured to connecting member 8. As such, a portion 29*b* of bar 29, extending from horizontal portion 29*a* along presser foot shoe 7**, moves up and down depending on the surface of the material passing thereunder but the portion rested on the surface of the material remains on it all the time, thereby enabling parallel stitching operations such as quilting to be accurately preformed regardless of the condition of the material surface.

Presser foot shoe 7 may be made of transparent material and, in which case, the portion 31 of its surface adjacent slot 9 and between the pair of supports 10 and 10' can be bellied so as to form a convex lens as shown in FIGS. 3 and 4, thereby enabling the operator to see therethrough even the small stitches he or she has made in a magnified way.

As shown in FIG. 8, trunk 5 also may have an aperture 42 below the lever 30 with a spring 41 and stud 40 which engages a stud recess in the slide part 17 (not shown) to hold the base on the trunk.

While specific embodiments of the invention have been shown and described in detail to illustrate the application of the principles of the invention, it will be understood that the invention may be embodied otherwise without departing from such principles.

What is claimed is:

1. A presser foot comprising:

a presser foot shoe having a first and second support thereon;

a connecting member adapted to be fixed to a presser foot bar having a first and second limb thereon;

said first support having a knob extending therefrom and said first limb having a groove thereon pivotally engaged with said knob when said shoe is connected to said connecting member;

said second support having a hole therein and said second limb having a hole therein alignable with said second support hole with said shoe connected to said connecting member;

a pin positioned in said holes when they are aligned; and lever means engaged with said pin including a biasing spring biasing said pin into said second limb hole, said lever means being movable against the bias of said biasing spring to remove said pin from said second limb hole to disengage said shoe from said connecting member.

2. A presser foot according to claim 1, wherein said second support includes a notch cut into a corner thereof spaced from said second support hole against which said pin is movable to move said pin against the bias of said biasing spring to permit alignment of said second limb hole with said second support hole.

3. A presser foot according to claim 2, wherein said lever means comprises a lever having an engagement end and an opposite end with a keyhole engaged over said pin, said pin including inner and outer rims for engaging said lever therebetween, said lever having a hole therein intermediate the ends of said lever, said second limb including an additional hole for receiving a rivet which extends through said intermediate lever hole, said biasing spring positioned around said rivet and against said lever in the vicinity of said intermediate lever hole.

4. A presser foot according to claim 1, wherein said connecting member comprises a base which carries said first and second limbs, including a slide part having a step, and a trunk having a cut therein for receiving said slide part, with said step fixing the relative positions of said trunk and base.

5. A presser foot according to claim 1, wherein said connecting member includes a non-circular recess therein, said presser foot including a stitch guide bar which is useful in making parallel stitches, said stitch guide bar having a horizontal portion with a non-circular cross-section engaged into said connecting member recess, and elastic lever means connected to said connecting member and engaged over said recess and horizontal bar portion therein for retaining said horizontal bar portion in said recess.

6. A presser foot according to claim 5, wherein said connecting member comprises a base carrying said limbs and a trunk carrying said recess, said trunk including a cut and said base including a slide part slid into said cut for engaging said trunk to said base.

7. A presser foot according to claim 6, including an aperture in said trunk under said elastic lever, a spring in said aperture and a stud in said aperture biased by said spring toward said cut of said trunk, said slide part of said base having a stud recess therein for receiving said stud with said base and trunk connected to each other.

8. A presser foot according to claim 1, wherein said presser foot shoe is made of transparent material, said shoe including a slot for receiving a needle and a portion of said shoe adjacent said slot being convex and forming a lens for viewing stitches under said shoe.

* * * * *